United States Patent [19]

Saito et al.

[11] Patent Number: 4,499,882

[45] Date of Patent: Feb. 19, 1985

[54] SYSTEM FOR CONTROLLING AIR-FUEL RATIO IN INTERNAL COMBUSTION ENGINE

[75] Inventors: Kimitaka Saito, Okazaki; Tokio Kohama, Nishio; Tsuneyuki Egami, Aichi; Tsutomu Saito, Okazaki; Susumu Nogami; Yukio Suzuki, both of Toyota, all of Japan

[73] Assignees: Nippon Soken, Inc., Nishio; Toyota Jidosha Kabushiki Kaisha, Toyota, both of Japan

[21] Appl. No.: 566,815

[22] Filed: Dec. 29, 1983

[30] Foreign Application Priority Data

Jan. 14, 1983 [JP] Japan ..... 58-3288

[51] Int. Cl.[3] ..... F02B 3/00

[52] U.S. Cl. ..... 123/492; 123/440; 123/489

[58] Field of Search ..... 123/489, 492, 493, 440

[56] References Cited

U.S. PATENT DOCUMENTS

| | | | |
|---|---|---|---|
| 4,077,364 | 3/1978 | Aoki | 123/440 |
| 4,130,095 | 12/1978 | Bowler et al. | 123/480 |
| 4,240,389 | 12/1980 | Shimazaki | 123/492 |
| 4,270,503 | 6/1981 | Pomerantz | 123/480 |
| 4,319,327 | 3/1982 | Higashiyama | 123/492 |
| 4,411,232 | 10/1983 | Atago | 123/492 |

*Primary Examiner*—Ronald B. Cox

*Attorney, Agent, or Firm*—Cushman, Darby & Cushman

[57] ABSTRACT

A system for controlling the air-fuel ratio of an internal combustion engine includes a transient fuel amount increasing device for regulating the supply fuel amount in the transient state of the engine on the basis of the detection of the transient state of the engine, an air-fuel ratio deviation detecting device for detecting the air-fuel ratio deviation from the optimum air-fuel ratio, and a transient fuel increase amount correcting device for correcting the fuel increase amount in the transient state of the engine in accordance with the air-fuel ratio deviation detected by the air-fuel ratio deviation detecting device. The air-fuel deviation from the optimum air-fuel ratio of the air-fuel mixture upon deposition of a deposit on the back surface of the intake valve is prevented, and the drivability of an automobile is improved.

9 Claims, 14 Drawing Figures

Fig. 3 B
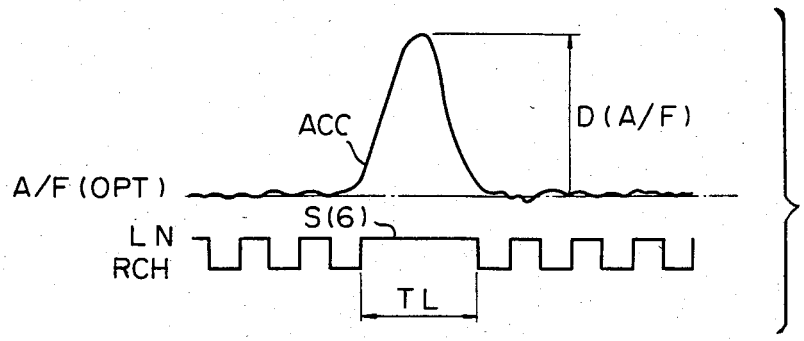
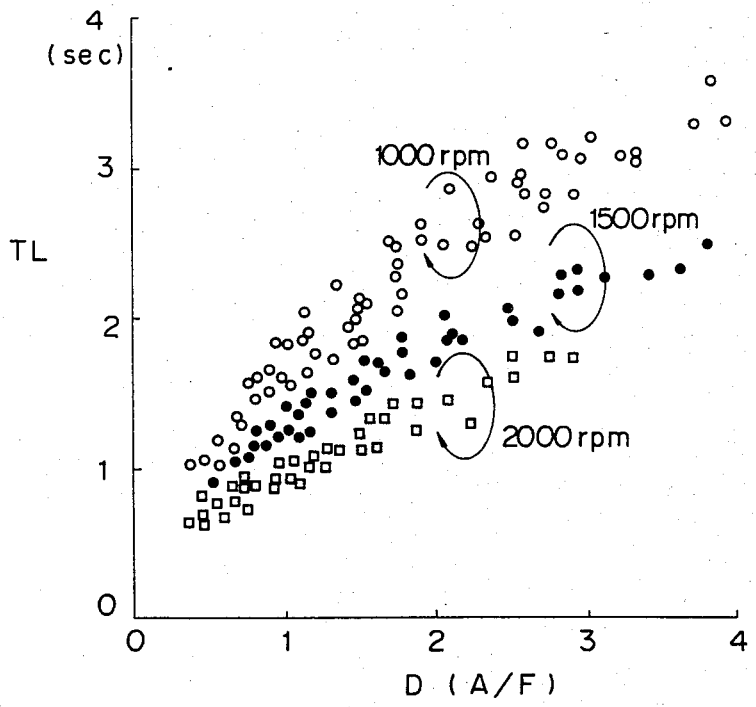
FIG. 3A

Fig. 4 B
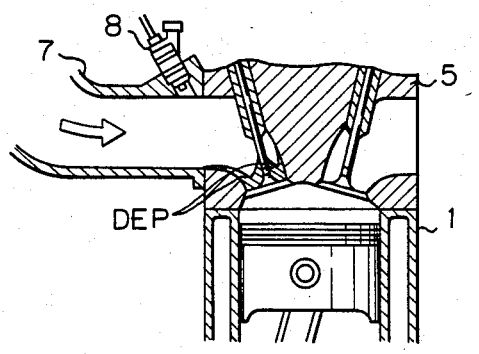
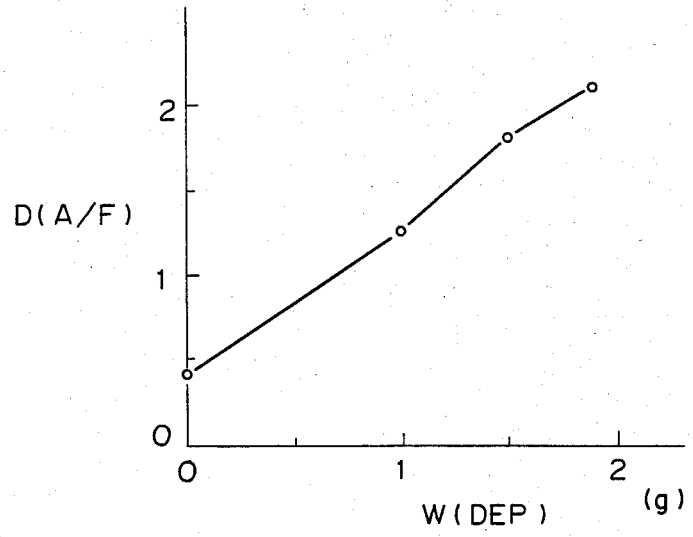
FIG. 4A

| Fig. 6 A | Fig. 6 B |
|---|---|

SYSTEM FOR CONTROLLING AIR-FUEL RATIO IN INTERNAL COMBUSTION ENGINE

BACKGROUND OF THE INVENTION

1. Field of the Invention

The present invention relates to a system for controlling the air-fuel ratio in an internal combustion engine. The system of the present invention is convenient for use in an automobile engine.

2. Description of the Prior Art

A system for controlling the air-fuel ratio in an internal combustion engine is conventionally known. The system of this type comprises, for example, means for generating a fundamental fuel signal representing an engine fuel request in a steady state of the engine in accordance with values of predetermined engine operation parameters including an engine temperature and representing an engine fuel request; means for detecting a transient state, i.e., acceleration or deceleration, of an engine indicating an output increase request; means, responsive to the measured engine temperature and the detected transient state of the engine, for generating a reinforce promotion signal which has the initial value thereof determined by the detected transient state of the engine and which is increased by a factor changing toward 1 at a rate determined by the measured engine temperature; and means for supplying fuel to the engine in accordance with the fundamental fuel signal and the reinforce promotion signal in accordance with the steady and transient states of the engine. The system provides a fuel supply system which achieves an optimum air-fuel ratio at any time in either a steady state or a transient state of the engine so that the engine continuously operates in an optimum state, as disclosed in for esample, Japanese unexamined Patent Publication (Kokai) No. 56-6034.

In this system, no consideration is given to a change in operating conditions of the engine over a period of time, that is, a change in characteristics due to presence of a deposit which is, for example, a viscous material such as carbon fine particles originating from lubricant components and fuel reaction products at the valve clearance or at an injection nozzle of an EFI injector, a change in characteristics due to presence of such a deposit at the back surface of a cylinder intake valve, and the like. Since the system does not have a means for detecting an air-fuel ratio representing a lean mixture in a transient state of the engine over a period of time, the system cannot prevent a lean mixture from being supplied to the engine in a transient state. This may adversely affect drivability and may, for example, cause an unreliable action in a transient state of the engine. In addition to the above problem, the conventional system is subject to further problems. For example, when an injector is clogged, correction can be made by feedback from an air-fuel ratio sensor when the engine is in the steady state. However, the conventional system does not have a correcting means for providing a similar correction when the engine is in a transient state. Furthermore, similar problems occur due to variations arising during the manufacture of the engines, air flow meters, and the like, or variations arising after the manufacture of these parts.

SUMMARY OF THE INVENTION

The main object of the present invention is to provide a system for controlling the air-fuel ratio in an internal combustion engine, comprising a transient fuel amount increasing device, an air-fuel ratio deviation detecting device, and a transient fuel increase amount correcting device, wherein the transient fuel increase amount correcting device controls the transient fuel increase amount so as to compensate for the air-fuel ratio deviation from the optimum air-fuel ratio which is detected by the air-fuel ratio deviation detecting device. Any deviation of the air-fuel ratio from the optimum air-fuel ratio may be prevented which is due to changes in characteristics over a period of time of the engine or of the intake air amount sensor which are caused by the presence of a deposit or clogging of the injector. The system of the present invention can therefore maintain the optimum performance of an automobile for a long period of time, and improves the drivability of the automobile.

It is another object of the present invention to provide a system for controlling the air-fuel ratio in an internal combustion engine, which prevents a deviation of the air-fuel ratio from the optimum air-fuel ratio in a transient state due to variations arising in the manufacture of the engine or an air flow meter, in addition to changes in the engine operation characteristics over a period of time.

According to the present invention, there is provided a system for controlling the air-fuel ratio in an internal combustion engine, including a transient fuel amount increasing device for regulating the supply fuel amount in the transient state of the engine on the basis of the detection of the transient state of the engine; an air-fuel ratio deviation detecting device for detecting the deviation of the air-fuel ratio from the optimum air-fuel ratio in the transient state of the engine; and a transient fuel increase amount correcting device for correcting the fuel increase amount in the transient state of the engine in accordance with the air-fuel ratio deviation detected by the air-fuel ratio deviation detecting device.

BRIEF DESCRIPTION OF THE DRAWINGS

In the drawings.

FIG. 3A is a graph showing the relationship between the air-fuel ratio characteristics and the characteristics of the air-fuel ratio sensor in a transient state;

FIG. 3B depicts signals for assisting the understanding of FIG. 3A;

FIG. 4A is a graph showing the relationship between the amount of deposit on the intake air system and the air-fuel ratio characteristics in a transient state;

FIG. 4B shows in cross section a portion of an engine for assisting the understanding of FIG. 4A;

DETAILED DESCRIPTION OF THE PREFERRED EMBODIMENTS

Figure 1:
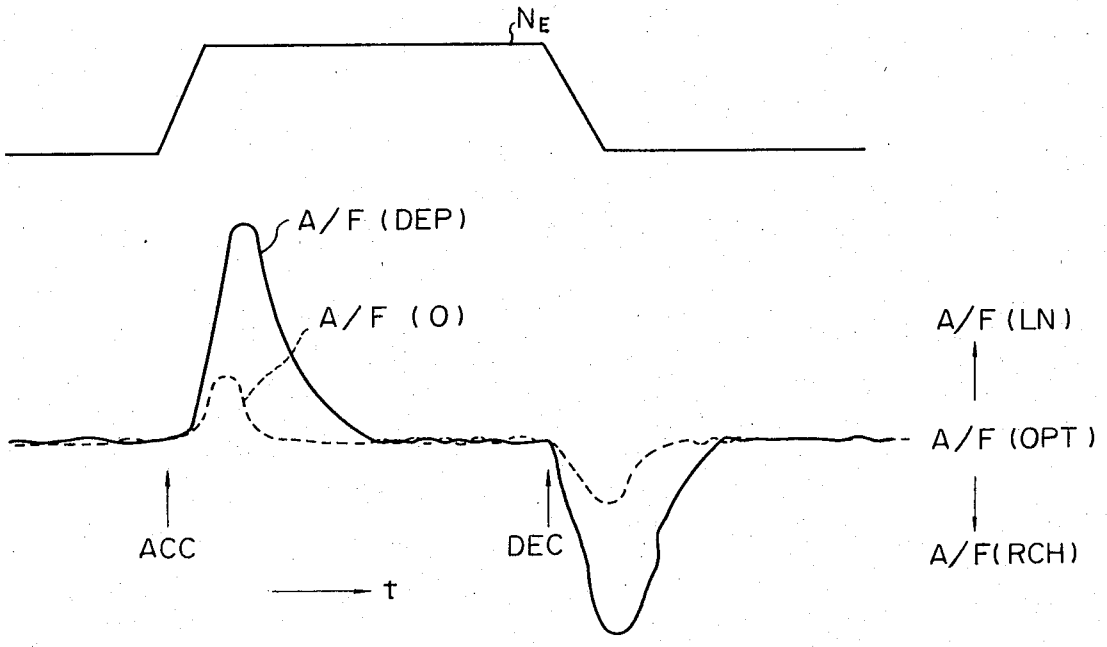
FIG. 1 shows the waveforms of the transient air-fuel ratio curves before and after the deposition of a deposit.

In a conventional system disclosed in, for example, the above-mentioned Japanese unexamined Patent Publication (Kokai) No. 56-6034, no consideration is given to a change in operating conditions of the engine over a period of time, that is, a change in characteristics due to presence of a deposit which is, for example, a viscous material such as carbon fine particles originating from lubricant components and fuel reaction products) at the valve clearance or at an injection nozzle of an EFI injector, a change in characteristics due to presence of such a deposit at the back surface of a cylinder intake valve, and the like. Since the system does not have a means for detecting an air-fuel ratio representing a lean mixture in a transient state of the engine over a period of time, the system cannot prevent a lean mixture from being supplied to the engine in a transient state. This may adversely affect drivability and may, for example, cause an unreliable action in a transient state of the engine. FIG. 1 shows changes in the air-fuel ratio in a case wherein such a deposit is present on the back surface of the intake valve. Referring to FIG. 1, curve NE represents the engine speed, curve A/F(O) represents the air-fuel ratio before deposition of the deposit, and curve DEP represents the air-fuel ratio after deposition of the deposit. In FIG. 1, symbol ACC represents an acceleration time; DEC, a deceleration time; A/F(OPT), an optimum air-fuel ratio; A/F(LN), a lean mixture; and A/F(RCH), a rich mixture.

Figure 2A:
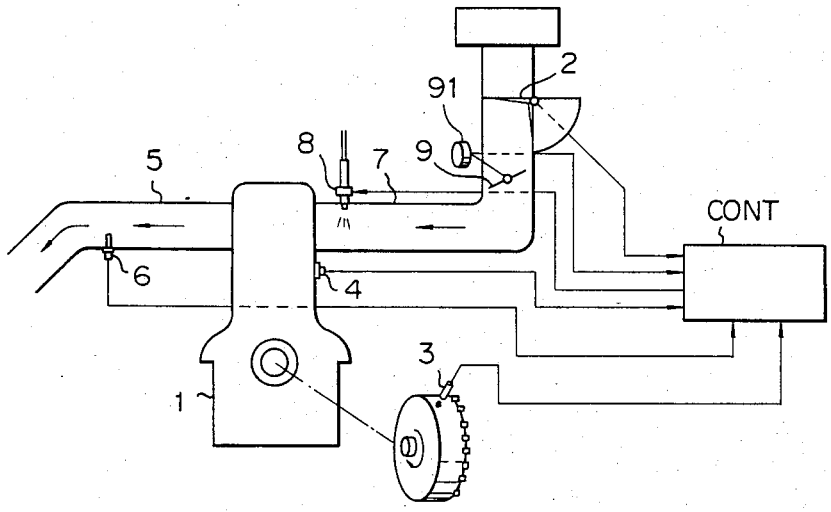
FIG. 2A is a schematic diagram of a system for controlling the air-fuel ratio according to an embodiment of the present invention.

In FIG. 2A is shown a system for controlling the air-fuel ratio in an internal combustion engine according to an embodiment of the present invention.

In the system shown in FIG. 2A, reference numeral 1 denotes a known electronically controlled fuel injector-type 6-cylinder spark-ignition engine as a power source of an automobile; 2, a known intake air amount sensor for detecting the intake air amount supplied to the engine 1; 3, a known engine speed sensor for detecting the speed of the engine 1; 4, a known water temperature sensor for measuring the cooling water temperature of the engine 1; 5, an exhaust passage of the engine 1; 6, a known air-fuel ratio (A/F) sensor arranged in the exhaust passage 5; 7, an intake pipe of the engine 1; 8, a known electromagnetic fuel injection valve in the intake pipe 7; 9, a throttle valve for controlling the air amount supplied to the engine 1; 91, a known throttle sensor for detecting the movement of the throttle valve 9; and CONT, a control circuit for calculating the fuel amount to be supplied to the engine and for actuating the fuel injection valve 8.

In order to determine the fuel amount to be supplied to the engine 1 in the steady state, the control circuit CONT calculates the fundamental injection amount in accordance with detection signals from the intake air amount sensor 2, the engine speed sensor 3, and the water temperature sensor 4. The control circuit CONT then calculates the opening time of the fuel injection valve 8 upon correcting the fundamental injection amount in accordance with the feedback correction value obtained from the signal from the A/F sensor 6.

Upon detection of a transient state of the engine 1 by the throttle sensor 91 or the intake air amount sensor 2, the control circuit CONT performs a transient fuel amount increase of the fundamental injection amount which is determined in the steady state of the engine 1.

Figure 2B:
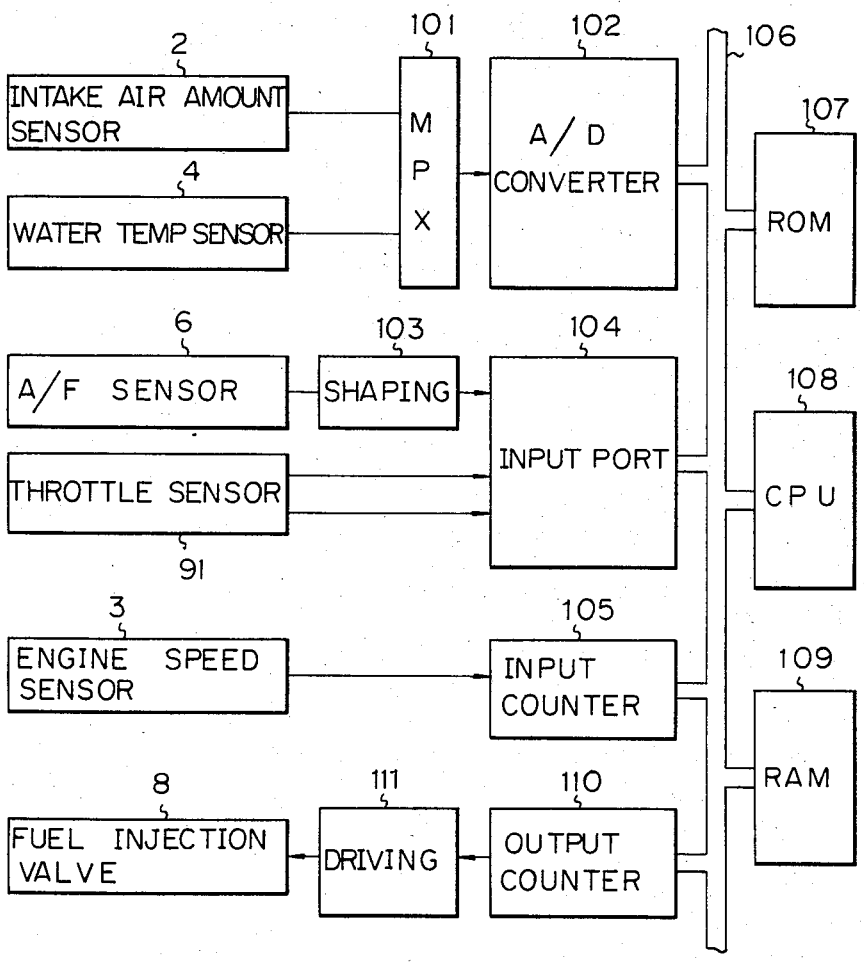
FIG. 2B shows the structure of a control circuit in the system shown in FIG. 2A.

In FIG. 2B is shown the configuration of the control circuit CONT in the system shown in FIG. 2A. The control circuit CONT has, as an input system, a multiplexer 101 for receiving output signals from the intake air amount sensor 2 and the water temperature sensor 4, an A/D converter 102, a shaping circuit 103 for receiving an output signal from the A/F sensor 6, an input port 104 for receiving output signals from the shaping circuit 103 and the throttle sensor 91, and an input counter 105 for receiving an output signal from the engine speed sensor 105. The control circuit CONT also has a bus 106, a ROM 107, a CPU 108, a RAM 109, an output counter 110, and a driving circuit 111. An output from the driving circuit 111 is supplied to the fuel injection valve 8.

The control circuit CONT may be of a microcomputer-type and may be, for example, the TCCS model from the Toyota Motor Co., Ltd. The air-fuel ratio deviation detecting device and the transient fuel increase amount correcting device are added to the control circuit CONT.

FIGS. 3A and 3B show a graph of the relationship between the air-fuel ratio characteristics in a transient state, that is a maximum air-fuel ratio deviation D(A/F) from the optimum air-fuel ratio A/F(OPT) toward a lean mixture side in a transient state, and the behavior of the air-fuel ratio sensor in a transient state, that is time for which the A/F sensor 6 detects a lean state of the gas mixture, that is, lean time TL in a transient state, using the speed of the engine as a parameter. In FIG. 3B, the transient state is an acceleration state, ACC represents acceleration time, and S(6) is an air-fuel ratio sensor signal.

In FIG. 4A is shown the relationship between the amount of a deposit W(DEP) attached to the intake air system and a maximum air-fuel ratio deviation D(A/F) in an acceleration state, as an example of an air-fuel ratio deviation from the optimum air-fuel ratio. It can be seen from FIGS. 3A and 4A that the amount of deposit can be calculated by measuring the lean time TL in the acceleration state. The engine used in collecting the data shown in FIG. 4A was a 5M-G type engine manufactured by the Toyota Motor Co., Ltd.

Figure 5:
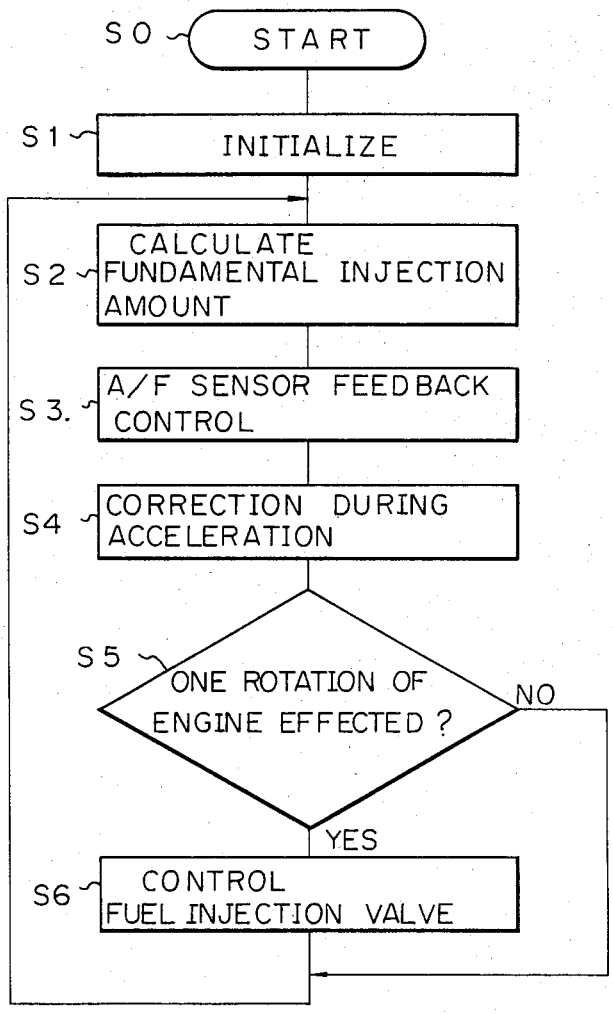
FIG. 5 is a flow chart showing an example of a control program to be used in the system of the present invention.

In FIG. 5 is shown a schematic flow chart of a control program of the control circuit CONT. This control program is for performing electronically controlled fuel injection and consists of steps S0 to S6. The sequence is started in step S0, and initialization of the memories, input/output ports, and the like is performed in step S1. In step S2, the fundamental injection amount is calculated from data Q of the intake air amount, data N of the engine speed, and data $\theta_W$ of the water temperature sensor. In step S3, feedback control is performed using the signal from the A/F sensor 6 and the fundamental injection amount is corrected so that the air-fuel ratio is kept constant. In step S4, the initial acceleration fuel amount increase and the amount of deposit are detected, and the initial acceleration fuel amount increase is corrected in accordance with the detected amount of deposit. In step S5, it is checked if the engine has rotated once (the decision for one rotation of the engine is carried out in step S5). Every time the engine rotates once, the open time of the fuel injection valve 8 is calculated from the fundamental injection amount corrected by feedback control and the acceleration fuel amount increase, and fuel injection valve control is performed in step S6.

Figures 6, 6A:
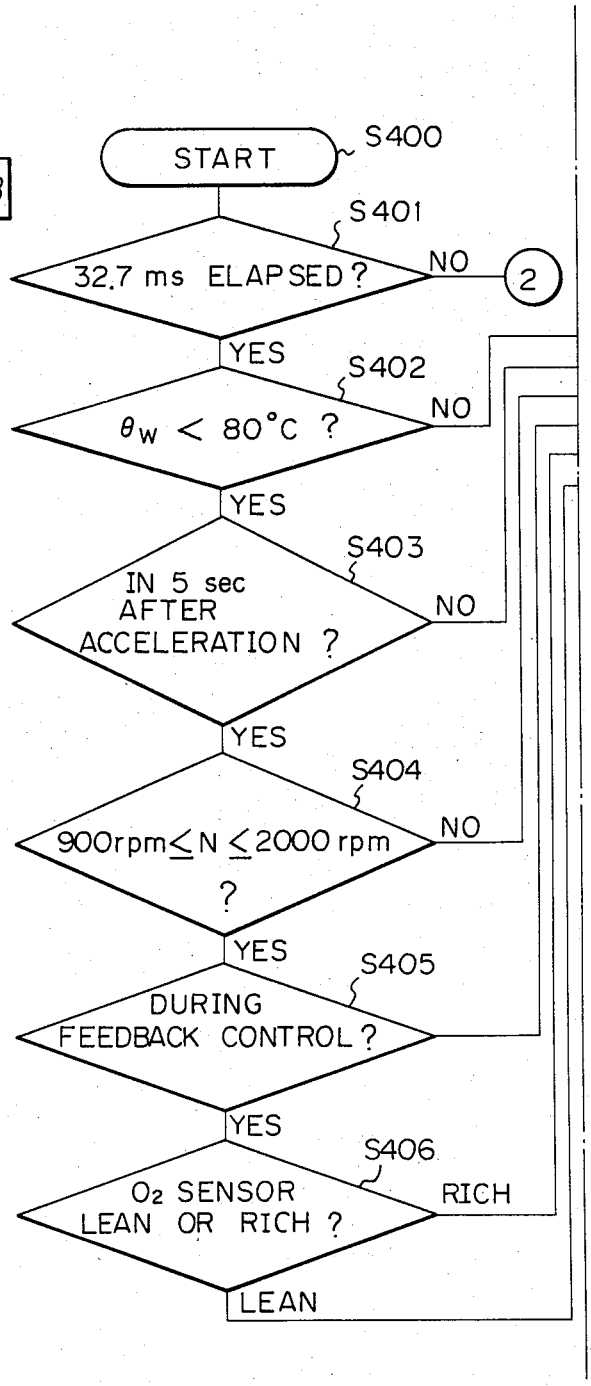
FIGS. 6A and 6B are flow charts showing the details of the flow of the detection of the amount of deposit.
Figure 6B:
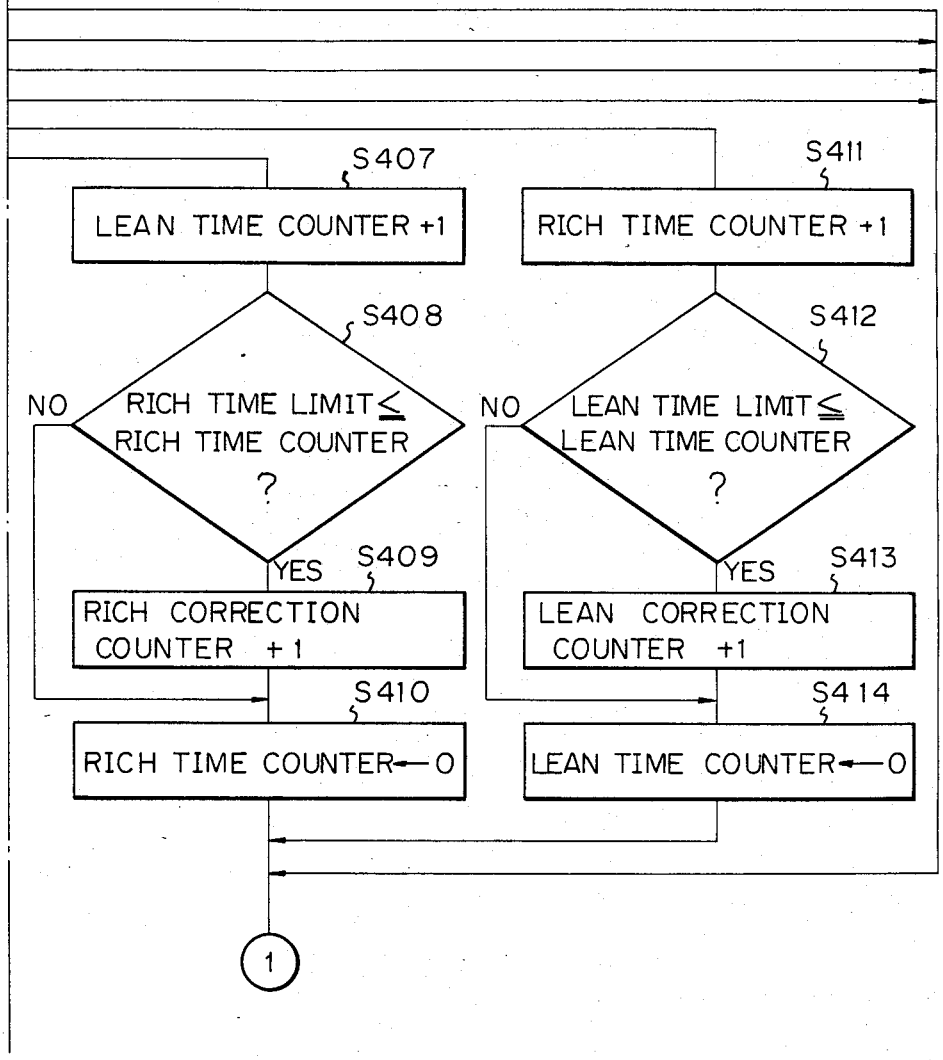
Figure 7:
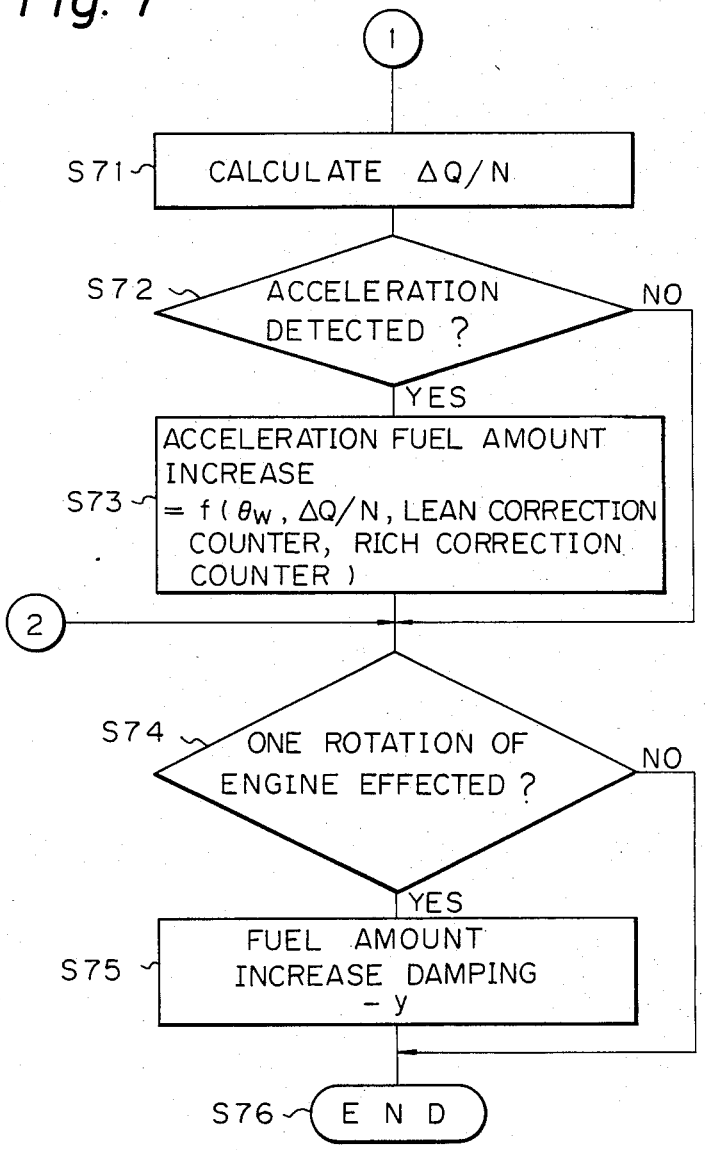
FIG. 7 is a flow chart showing the details of the flow of the increasing of the initial fuel amount increase in a transient state.

In FIG. 6 is shown a flow chart giving details of the detection of the air-fuel ratio deviation, and in FIG. 7 is shown a flow chart giving details of the detection of the initial acceleration fuel amount increase and correction of the acceleration fuel amount increase in accordance with the detected initial acceleration fuel amount increase.

The correction during acceleration shown in FIGS. 6 and 7 is performed at predetermined intervals, e.g., 32.7 ms, as shown in step 401. According to the method for detecting the air-fuel ratio deviation adopted, an output signal from the A/F sensor 6 is compared with a constant reference voltage so as to detect the binary state, that is lean or rich state, of the air-fuel gas mixture. The lean time TL and rich time TR during acceleration are measured. The effect of the presence of the deposit is significant only when the cooling water temperature is relatively low. In order to facilitate detection of the amount of deposit, the lean time TL and the rich time TR are measured for only the cooling water temperature of below 80° C., the time after acceleration of within 5 seconds, and an engine speed of 900 to 2,000 rpm. The measurement time is limited to be during feedback control is step S405 so that the rich and lean states are alternately obtained. In step S406, it is checked if the A/F sensor output represents a rich or lean mixture. If the rich mixture is detected, in step S407, the lean time counter is incremented by one, and the lean time TL is counted in units of 32.7 ms. It is then checked in step S408 if the count of the rich time counter has reached a predetermined value, that is the rich time limit. If YES in step S408, the rich correction counter is incremented by one in step S409. Then, in step S409, the rich time counter is cleared.

If the rich mixture is detected in step S406, the rich time counter is incremented by one and it is checked if the lean time has elapsed in steps S411 to S414. The presence or absence of the deposit can be determined from the counts of the lean correction counter and the rich correction counter, which are obtained in steps S406 to S414. In other words, a change from the normal state to an abnormal state or from the abnormal state to the normal state of the engine can be determined.

In the flow shown in FIG. 7, in step S71 the rate of change $\Delta(Q/N)$ is calculated from the intake air amount Q/N per rotation of the engine where Q is an intake air amount signal from the intake air sensor 2 and N is an engine speed signal from the engine speed sensor 3. When $\Delta(Q/N)$ is positive, the engine is in the acceleration state. If it is determined in step S72 that $\Delta(Q/N)$ is positive and exceeds a predetermined value, it is determined that the engine is in the acceleration state and the flow advances to step S73.

In step S73, the acceleration fuel amount increase is calculated as a function of the cooling water temperature, $\Delta(Q/N)$, the lean correction counter count, and the rich correction counter count. More specifically, the increase ratio per unit $\Delta(Q/N)$ for each cooling water temperature is stored in a map form in a memory. The increase ratio corresponding to the detected cooling water temperature is read out from the memory and is multiplied by the $\Delta(Q/N)$. The product obtained is corrected in accordance with the counts of the lean and rich correction counters, thereby calculating the acceleration fuel amount increase. The increase is given as an initial value upon the detection of acceleration.

In steps S74 and S75, the acceleration fuel amount increase is decremented by a predetermined value (Y) upon every rotation of the engine until it finally reaches 0.

Figure 8:
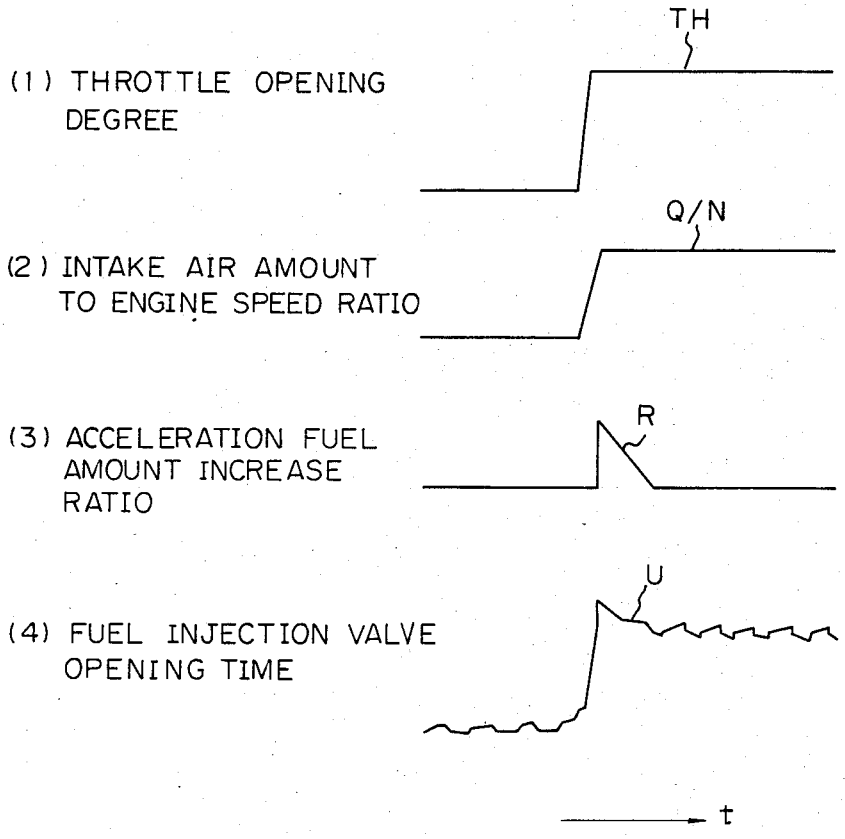
FIG. 8 shows the waveforms of the signals in the control circuit in FIG. 2B.

Thus, as shown in FIG. 8, (1) when the throttle valve is opened for acceleration (TH is the throttle opening degree), (2) the value of Q/N increases, (3) the acceleration fuel amount increase ratio R is increased as shown in the figure, and (4) the fuel injection valve opening time U is determined, and the fuel is supplied accordingly.

Figure 9:
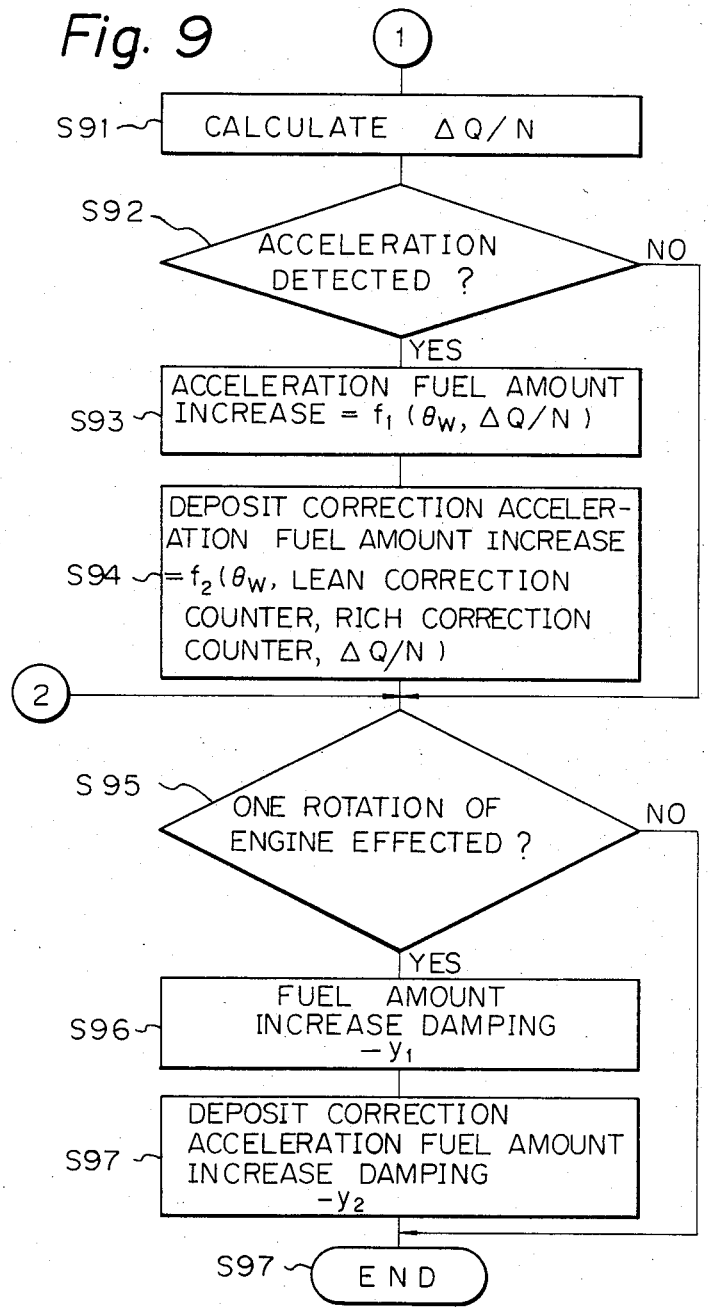
FIG. 9 is a flow chart showing the details of the flow of the calculation of the fuel amount increase and calculation for correction in the presence of a deposit in a transient state according to another embodiment of the present invention.

The present invention is not limited to the particular embodiment described above, and various other changes and modifications may be made. For example, in the above embodiment, as shown in step S73, the initial acceleration fuel amount increase upon deposition of the deposit was changed in accordance with the counts of the lean and rich correction counters. However, the flow as shown in FIG. 9 may alternatively be adopted. In the flow shown in FIG. 9, the initial acceleration fuel amount increase is determined irrespective of the presence or absence of the deposit and is determined in accordance with the water temperature $\theta_W$ and $\Delta(Q/N)$ when the automobile is in the acceleration state. In addition to this, correction may be performed only upon detection of the presence of the deposit.

Referring to FIG. 9, when acceleration is detected in step S92, the acceleration fuel amount increase is calculated from the cooling water temperature and the $\Delta(Q/N)$. In step S94, the deposit correction acceleration fuel amount increase is calculated. The acceleration fuel amount increase corresponding to the amount of deposit is calculated as a function of the cooling water temperature, the counts of the lean and rich correction counters, and the $\Delta(Q/N)$. Upon each rotation of the engine, the acceleration fuel amount increase and deposit correction acceleration fuel amount increase are damped by predetermined values y1 and y2, respectively, until they reach 0. The fuel amount is increased by multiplying the acceleration fuel amount increase and the deposit correction acceleration fuel amount increase by the fundamental injection amount.

Figure 10:
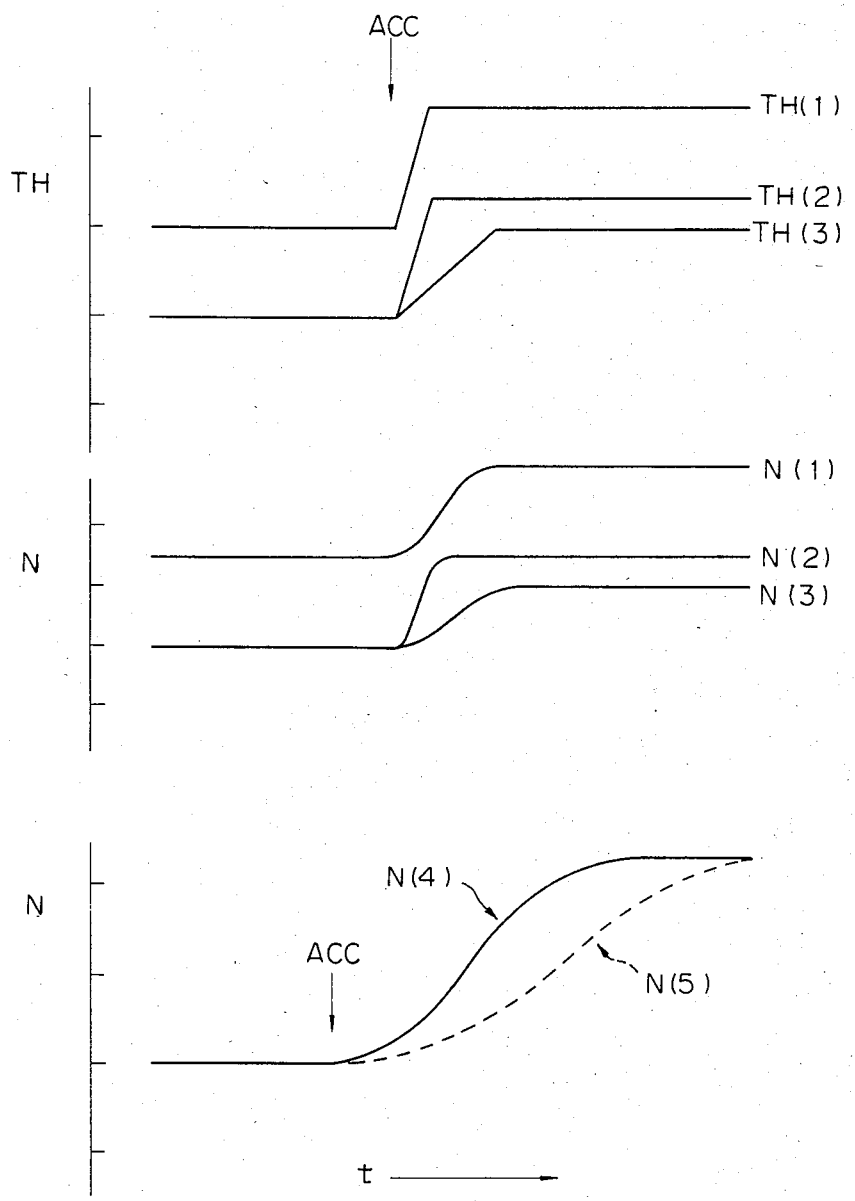
FIG. 10 illustrates the change of the operation characteristics of the system of FIG. 2A.

Furthermore, in the embodiment described above, the time TL and TR during acceleration are detecting means for detecting the amount of deposit. However, the air-fuel ratio and the torque hold a close relationship. In particular, when the $\Delta(A/F)$ is great during acceleration, the torque is unreliable and the engine speed cannot increase immediately. Accordingly, the amount of deposit can also be determined from the slow slope of the engine speed increase. In other words, an engine speed sensor for detecting the engine speed may be adopted as a means for indirectly determining the amount of deposit. FIG. 10 shows the characteristics obtained in this case.

The diagram at the top of FIG. 10 shows changes in the throttle opening degree TH over a period of time, and the second diagram from the top shows changes in the engine speed data N of the engine over a period of time. Acceleration is effected at time ACC. Engine speed characteristics N(1), N(2), and N(3) are obtained at different acceleration conditions, that is before acceleration or change in the degree of throttle opening. If the acceleration conditions are the same, the same engine speed characteristic of the engine is obtained.

The third diagram from the top in FIG. 10 shows the engine speed characteristic N(4) when no deposit is present and the engine speed characteristic N(5) when the deposit is present. In the case of the engine speed characteristic N(5), a satisfactorily high torque is not obtained due to a lean mixture and a sharp engine speed increase characteristic cannot be obtained. Thus, different engine speed characteristics N(5) and N(4) are obtained in accordance with the presence or absence of the deposit.

In the above embodiment, values, such as changes in engine speed per unit of time, indicating the engine speed characteristics under various acceleration conditions and under the condition of no deposit are stored in a memory. The detected value of the engine speed characteristic from the engine speed sensor during acceleration is compared with the value of the engine speed characteristic stored in the memory and corresponding to the acceleration condition detected by the acceleration condition sensors, such as a throttle opening degree sensor or an intake air amount sensor, thereby detecting the presence of deposit.

In the above embodiment, the values indicating the engine speed characteristic under various acceleration conditions are stored in a memory. However, the presence of deposit may alternatively be detected by storing an equation for calculating the value representing the engine speed characteristic from each acceleration condition and comparing the detected engine speed with the calculated value in accordance with the equation. In the above embodiment, the air-fuel ratio deviation is corrected upon detection of the presence of deposit. However, similar corrections may be made for the clogging of an EFI injector, variations in the air flow meter characteristics, or variations in the speed density type pressure sensor.

Although the above description is made wherein the transient state is an acceleration state, similar control may also be performed when the transient state is a deceleration state.

We claim:

1. A system for controlling the air-fuel ratio in an internal combustion engine comprising:

a transient fuel amount increasing means for regulating the supply fuel amount in the transient state of the engine on the basis of the detection of the transient state of the engine;

an air-fuel ratio deviation detecting means for detecting the deviation of the air-fuel ratio in the transient state of the engine from the optimum air-fuel ratio; and a transient fuel increase amount correcting means for correcting the fuel increase amount in the transient state of the engine in accordance with the air-fuel ratio deviation detected by said air-fuel ratio deviation detecting means.

2. A system according to claim 1, wherein an air-fuel ratio sensor is used for said air-fuel ratio deviation detecting means.

3. A system according to claim 1, wherein an engine speed sensor for detecting the engine speed of said engine is used for said air-fuel ratio deviation detecting means.

4. A system according to claim 1, wherein said transient fuel increase amount correcting means corrects at least one of the parameters for deciding said transient fuel increase amount in accordance with the air-fuel ratio deviation detected by said air-fuel ratio deviation detecting means.

5. A system according to claim 1, wherein said transient fuel increase amount correcting means is provided as a means other than said transient fuel amount increase means, and changes at least one of the parameters for deciding the transient fuel increase amount correction value in accordance with the air-fuel ratio deviation detected by said air-fuel ratio deviation detecting means, and effecting simultaneously the transient fuel amount increase and the fuel amount increase by said transient fuel increase amount correcting means in the transient state of the engine.

6. A system according to claim 1, wherein said air-fuel ratio deviation is a deviation caused by a deposit which is deposited in an air intake portion of said engine.

7. A system according to claim 1, wherein said air-fuel ratio deviation is a deviation caused by a deposit which is deposited on a nozzle range of a fuel injector in said engine.

8. A system according to claim 1, wherein said air-fuel ratio deviation is a deviation caused by the variation of the structure during manufacture between the manufactured air amount detecting means for said engine or the long time variation of the operation characteristic of the intake air amount detecting means of said engine.

9. A system according to claim 1, wherein said air-fuel ratio deviation is a deviation caused by variations of the structure during manufacture between the manufactured engines or the long time variation of the operation characteristic of said engine.

* * * * *